US007033449B2

(12) United States Patent
Schaefer et al.

(10) Patent No.: US 7,033,449 B2
(45) Date of Patent: Apr. 25, 2006

(54) ADDITIVE FOR COMPOSITION B AND COMPOSITION B REPLACEMENTS THAT MITIGATES SLOW COOK-OFF VIOLENCE

(75) Inventors: Ruth A. Schaefer, North Ogden, UT (US); Robert L. Hatch, Wellsville, UT (US); Daniel W. Doll, Ogden, UT (US)

(73) Assignee: Alliant Techsystems Inc., Edina, MN (US)

( * ) Notice: Subject to any disclaimer, the term of this patent is extended or adjusted under 35 U.S.C. 154(b) by 143 days.

(21) Appl. No.: 10/385,379

(22) Filed: Mar. 10, 2003

(65) Prior Publication Data

US 2004/0200378 A1 Oct. 14, 2004

(51) Int. Cl.
*C06B 25/34* (2006.01)

(52) U.S. Cl. ..... 149/92

(58) Field of Classification Search ..... 60/223, 60/253; 149/92

See application file for complete search history.

(56) References Cited

U.S. PATENT DOCUMENTS 4,137,849 A 2/1979 Hontgas et al.
4,394,197 A 7/1983 Kabik et al.
H969 H 10/1991 Yee
H973 H 10/1991 Chaykovsky et al.
5,054,399 A 10/1991 Bilek et al.
5,084,118 A 1/1992 Poole
5,218,166 A * 6/1993 Schumacher ..... 102/431
5,959,235 A 9/1999 Wagstaff
6,619,029 B1 * 9/2003 Solberg et al. ..... 60/223

OTHER PUBLICATIONS

Ho, et al., Insensitive Munitions Technology for Survivability, TACOM-ARDEC, date unknown, 1 page.*
Wardell, et al., "The Scaled Thermal Explosion Experiment", Lawrence Livermore National Laboratory, date unknown, pp. 1-10.*
Ho, et al., "Insensitive Munitions Technology for Survivability", TACOM-ARDEC, date unknown, 1 page.
Wardell, et al., "The Scaled Thermal Explosion Experiment", Lawrence Livermore National Laboratory, date unknown, pp. 1-10.
Meyer, Rudolf, Kohler, Joseph, and Homburg, Axel, *Explosives*, 5th completely revised ed., pp. 106 and 107, and 344 and 345, Wiley-VCH (no year provided).

* cited by examiner

*Primary Examiner*—John R. Hardee
(74) *Attorney, Agent, or Firm*—TraskBritt

(57) ABSTRACT

An explosive composition having a main explosive and an additive, such as 2,4-dinitrophenylhydrazine. The explosive composition is resistant to slow cook-off. The main explosive includes Composition B or a Composition B replacement. The 2,4-dinitrophenylhydrazine is present in the explosive composition at less than or equal to approximately 5% by weight. An insensitive munition resistant to slow cook-off is also disclosed, as is a method of forming the explosive composition having a main explosive and 2,4-dinitrophenylhydrazine and a method of mitigating slow cook-off violence.

19 Claims, 7 Drawing Sheets

ADDITIVE FOR COMPOSITION B AND COMPOSITION B REPLACEMENTS THAT MITIGATES SLOW COOK-OFF VIOLENCE

STATEMENT REGARDING FEDERALLY SPONSORED RESEARCH

The U.S. Government has a paid-up license in this invention and the right in limited circumstances to require the patent owner to license others on reasonable terms as provided for by the terms of Contract No. DAAE30-98-D-1005 awarded by the Armament, Research, Development and Engineering Center.

BACKGROUND OF THE INVENTION

1. Field of the Invention

The present invention relates to an explosive composition and, more specifically, to an explosive composition having reduced slow cook-off violence.

2. State of the Art

Composition B ("Comp B") is an explosive composition composed of trinitrotoluene ("TNT") (39.5%), cyclo-1,3,5-trimethylene-2,4,6-trinitramine ("RDX") (59.5%) and wax (1.0%). For decades, Comp B has been the workhorse explosive for bomb fills, grenades, and anti-personnel mines. Comp B's extensive use is, in part, a result of its physical properties, which are suitable for low-cost, safe manufacturing of ordnance. The excellent chemical and thermal stability of the Comp B ingredients assure that long life-cycles are achievable over a wide range of environmental conditions. Most importantly, Comp B's explosive performance is suitable for a broad range of ordnance applications.

Despite Comp B's versatility and extensive history, considerable improvements in quality, cost, and hazard characteristics have been achieved. Environmental concerns with the manufacture of TNT and its byproducts have eliminated domestic sources of TNT. Also, modern safety, hazards and sensitivity standards require that explosive ordnance exhibit reduced vulnerability and hazards sensitivity. High performance replacements for Comp B have been developed that have reduced hazard sensitivity and are produced using low cost and commercially available ingredients, preferably non-toxic omoncarcinogenic. One such replacement for Comp B is Picatinny Arsenal Explosive 21 ("PAX-21"). PAX-21, which is made of dinitroanisole ("DNAN"), ammonium perchlorate ("AP"), RDX, and n-methyl-4-nitroaniline ("MNA"), mimics the performance of Comp B.

When explosive compositions including RDX and TNT are heated to a temperature greater than approximately 392° F.–482° F., the explosive compositions begin a rapid, exothermic decomposition and begin to cook off. Cook-off is a hazard that affects design, testing, transportation, and storage of explosive compositions used in ordnance and occurs when the explosive composition is exposed to a source of heat. If the explosive composition is unconfined, the explosive composition ignites and burns when heated. A temperature necessary to ignite the explosive composition depends on the nature of the explosive composition. However, when stored in a confinement, such as a case, the explosive composition produces a violent reaction or explosion when heated. The explosion produces fragments of the confinement (shrapnel), which causes damage to any facilities and personnel in the vicinity of the munitions. A slow cook-off occurs when the explosive composition is exposed to indirect heat, such as when the explosive composition is stored in a facility that is adjacent to a fire. A fast cook-off situation occurs when the explosive composition is directly exposed to heat, such as when the fire is in a facility used to store the explosive composition. Explosive compositions that are insensitive to slow cook-off situations are highly desirable for military applications because they have increased safety in transportation and storage. To determine the explosive composition's tendency to cook off, the explosive composition is subjected to a gradual increase in temperature until a reaction occurs.

While PAX-21 provides a comparable melt/pour process, uses nontoxic ingredients, is less shock sensitive and shows lower sensitivity than Comp B, neither Comp B nor PAX-21 pass a slow cook-off test. In a slow cook-off test, the explosive composition is slowly heated until it ignites, explodes, decomposes, or in some other way reacts to the heat. The slow cook-off test models the temperature increase experienced by the explosive composition if it were adjacent to a burning container or storage facility. When PAX-21 or Comp B is in a slow cook-off situation, it will typically burn very quickly, unless it is confined. However, when the explosive composition is confined, the explosive composition explodes violently, sending pieces of the confinement shrapnel flying.

For the explosive composition to pass the NATO Insensitive Munitions Information Center's ("NIMIC") slow cook-off test, it must experience a Type V Response (burning) or better. This response type allows an energetic material in the explosive composition to ignite and burn without propulsion. In addition, the case used to confine the explosive composition must split non-violently, if at all. The internal pressure of the reaction is allowed to dislodge the case cover, but debris may be thrown no more than 15 meters, and that debris should be unlikely to cause a fatality. To be an insensitive munition ("IM"), the munition must minimize the probability of being inadvertently initiated and provide reduced severity of collateral damage to facilities and personnel when subjected to unintentional stimuli. For instance, the IM should burn when exposed to fast or slow heating and should not detonate when another munition located nearby detonates.

To reduce the violence of the explosion in a slow cook-off situation, cook-off resistant explosive compositions have been disclosed. In U.S. Pat. No. 4,394,197 to Kabik et al., a cook-off resistant booster explosive composition is disclosed. The explosive composition includes a mixture of 1,3,5-triamino-2,4,6-trinitrobenzene ("TATB"), RDX or cyclotetramethylenetetranitramine ("HMX"), and a binder, such as polytetrafluoroethylene. In addition, insulating layers that prevent or slow down the transfer of heat to the explosive composition have been developed. U.S. Pat. No. 4,137,849 to Hontgas et al. discloses a liner formed from a polyvinyl chloride resin-based plastisol and s-trithiane. The liner separates the explosive composition from the confinement to prevent heat from transferring between the two. U.S. Pat. No. 5,054,399 to Bilek et al. discloses a shock attenuation liner formed from layers of material of inwardly decreasing acoustic impedance. An attenuation barnier layer is formed by arranging an explosive composition in order of outwardly decreasing detonation sensitivity.

In addition to using cook-off resistant explosive compositions and insulating layers to provide resistance to cook-off, changes to the design of the case or confinement have been proposed. The confinement includes vents to allow gases to be released as they are generated, reducing the buildup of pressure inside the confinement. The vents enable the explosive composition to burn rather then explode.

In U.S. Pat. No. 5,959,235 to Wagstaff, a device used to ignite a propellant before it detonates is disclosed. The device uses two metals, a first metal that melts at a temperature below a detonation temperature of the propellant and a second metal that reacts with the first metal to produce an exothermic reaction that causes the propellant to burn. The first metal is sodium and the second metal is an alloy of bismuth, lead, tin, cadmium, tellurium, and/or antimony. The device is incorporated into an igniter or is located inside the propellant.

An autoigniting composition used in an automobile occupant restraint system is disclosed in U.S. Pat. No. 5,084,118 to Poole. The autoigniting composition includes an alkali metal or alkaline earth metal chlorate, 5-aminotetrazole, and 2,4-dinitrophenylhydrazine. The autoigniting composition is used in an aluminum pressure vessel to contain the composition and gases produced during ignition of the composition.

It would be desirable to provide an explosive composition that is resistant to slow cook-off. Specifically, it would be desirable to produce a Comp B or replacement for Comp B that mitigates violence and passes NIMIC's slow cook-off test.

BRIEF SUMMARY OF THE INVENTION

The present invention relates to an explosive composition comprising a main explosive and an additive. The explosive composition is resistant to slow cook-off. The main explosive comprises a composition of trinitrotoluene and cyclo-1,3,5-trimethylene-2,4,6-trinitramine or a composition of dinitroanisole, ammonium perchlorate, n-methyl-4-nitroaniline, and cyclo-1,3,5-trimethylene-2,4,6-trinitramine. The additive may be 2,4-dinitrophenylhydrazine and is present in the explosive composition at less than or equal to approximately 5% by weight.

The present invention also encompasses an insensitive munition resistant to slow cook-off. The insensitive munition comprises a confinement and an explosive composition comprising a main explosive and an additive. The main explosive comprises a composition of trinitrotoluene and cyclo-1,3,5-trimethylene-2,4,6-trinitramine or a composition of dinitroanisole, ammonium perchlorate, n-methyl-4-nitroaniline, and cyclo-1,3,5-trimethylene-2,4,6-trinitramine. The additive may include 2,4-dinitrophenylhydrazine and is present in the explosive composition at less than or equal to approximately 5% by weight.

The present invention also relates to a method of forming an explosive composition resistant to slow cook-off. The method comprises providing a main explosive comprising cyclo-1,3,5-trimethylene-2,4,6-trinitramine. The main explosive is melted and an additive, such as 2,4-dinitrophenylhydrazine, is added to the main explosive to form the explosive composition. The additive may be present at less than or equal to approximately 5% by weight.

The present invention also encompasses a method of mitigating slow cook-off violence. The method comprises providing an explosive composition comprising a main explosive and an additive. The additive may include 2,4-dinitrophenylhydrazine and is present in the explosive composition at less than or equal to approximately 5% by weight. The explosive composition is encased in a confinement. The additive is decomposed to form a gas and generate a sufficient pressure to open the confinement without producing shrapnel.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1:
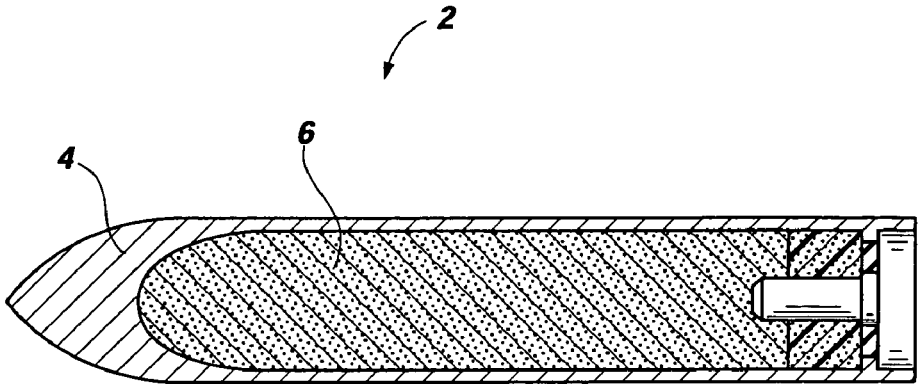
FIG. 1 is a schematic illustration of a warhead including the explosive composition of the present invention.

An additive is used in an explosive composition to mitigate violence during a slow cook-off. The additive is present in the explosive composition as a minor component so that performance of the explosive composition when detonated is not affected. The explosive composition also includes a main explosive that is present as a major component. The main explosive may be Comp B (trinitrotoluene and cyclo-1,3,5-trimethylene-2,4,6-trinitramine) or a Comp B replacement, such as PAX-21 (dinitroanisole, ammonium perchlorate, n-methyl-4-nitroaniline, and cyclo-1,3,5-trimethylene-2,4,6-trinitramine). Upon exposure to heat or energy, the additive may decompose to generate a gas that produces a sufficient pressure to break open or breach a case or confinement used to house the explosive composition. The confinement may be formed from a conventional material, such as steel, depending on the nature of the explosive composition. Depending on the material used in the confinement, the pressure necessary to breach the confinement may vary. For sake of example only, if an M107 projectile case is used to house the explosive composition of the present invention, the additive may produce a pressure of approximately 30,000 psi, which is sufficient to breach the M107 projectile case. However, if a different confinement is used, it is understood that the pressure required to break the confinement may vary. The pressure produced by the decomposing additive may be generated in a short amount of time so that the pressure buildup is sufficient to break the confinement. Once the confinement is opened, the explosive composition may react unconfined and at ambient pressure, which allows the main explosive to burn non-violently.

The additive may decompose at a temperature above the melting point of the main explosive and below a reaction temperature of a neat composition of the explosive composition. In other words, the additive may decompose at a temperature below a cook-off temperature of the neat explosive composition. The additive may also decompose at a temperature above a temperature used to process the explosive composition. As the additive decomposes, energy is generated in the form of heat. Desirably, the amount of heat generated may be insufficient to initiate the main explosive. The additive used in the explosive composition may include any chemical compound that satisfies these criteria.

Comp B has a melting point of approximately 176° F. (80° C.) and exotherms at approximately 326° F. (163° C.). For sake of example only, if Comp B is used as the main explosive, the additive may decompose at a temperature greater than approximately 176° F. (80° C.) and less than approximately 326° F. (163° C.). For safety reasons, it is desirable that the additive may decompose at a temperature above the melting point of the main explosive and above the processing temperature used to formulate the explosive composition.

The additive may be present in the explosive composition in an amount sufficient to mitigate the violence of the cook-off reaction without adversely affecting performance of the explosive composition. For instance, it is desirable that the additive not decrease a killing range of the explosive composition by more than 3%. The amount of additive present in the explosive composition may also be sufficient to generate an adequate gas pressure to breach the confinement without igniting the explosive composition. The amount of additive necessary to breach the confinement may depend on the material used as the confinement and on a degree to which the explosive composition is confined. In addition, the additive may be present in an amount sufficient to break the confinement without generating lethal shrapnel.

If the additive is present in the explosive composition in too high of an amount, the reaction may produce a large amount of heat that, undesirably, detonates the main explosive. However, if the additive is not present in a sufficient amount, the reaction may not generate adequate gas pressure to breach the confinement. The additive may be present in the explosive composition at less than or equal to approximately 5% by weight. Preferably, the additive is present in the explosive composition at less than or equal to approximately 4% by weight, such as from approximately 3% by weight to approximately 4% by weight. If DNPH is used as the additive with additional main explosives, such as those known in the art, it is understood that the amount of additive present in the explosive composition may be increased or decreased to produce the gas pressure adequate to open the confinement.

While the examples detailed herein describe explosive compositions having less than or equal to approximately 5% by weight of the additive, it is contemplated that the additive may be present in the explosive composition at a greater amount, such as at less than or equal to approximately 10% by weight. For instance, if additional confinement is placed on the explosive composition, the gas pressure necessary to breach the confinement may be increased. To generate the increased amount of gas pressure, an increased amount of the additive may be used in the explosive composition. However, it is understood that the amount of additive present in the explosive composition may not cause initiation of the main explosive or affect the performance of the explosive composition.

The additive may also have minimal adverse effects on conventional melt-pour processes, such as those used to produce Comp B and Comp B replacements. In other words, the additive may be incorporated into the explosive composition without modifying the existing melt-pour processes for Comp B and Comp B replacements. The explosive composition of the present invention may be formulated by melting the main explosive. The additive may be added as a drop-in addition to the molten main explosive. The mixture may then be cast into the explosive composition by conventional techniques.

Constraints on using the additive in an explosive composition having Comp B or a Comp B replacement are rigorous due to concerns with process safety and the cook-off temperatures of these main explosives. These concerns require that the additive used in the explosive composition of the present invention may fall within a very narrow range of acceptable decomposition temperatures. However, these concerns may not be present when other main explosives are used in the explosive composition. Therefore, the constraints may be less stringent with explosive compositions including other main explosives.

In one embodiment of the present invention, the additive in the explosive composition is 2,4-dinitrophenylhydrazine ("DNPH"). DNPH is commercially available from numerous chemical suppliers, such as Sigma-Aldrich Co. (St. Louis, Mo.). DNPH is shipped damp to reduce its sensitivity during transportation and storage and, therefore, the DNPH is dried before being used in the explosive composition of the present invention. DNPH is added to Comp B or PAX-21 at less than or equal to approximately 5% by weight to mitigate the violence of the cook-off reaction. To formulate the explosive composition of the present invention, the DNPH is added in the conventional melt-pour processes used for Comp B or PAX-21.

When the explosive composition is exposed to a slow cook-off situation, the DNPH decomposes at a temperature below the cook-off temperature of the Comp B or PAX-21. As the temperature surrounding the explosive composition increases, the DNPH decomposes and produces a gas having a sufficient pressure to breach the confinement housing the explosive composition. Once the confinement is opened, the Comp B or PAX-21 is unconfined and burns, rather than explodes, when heated to its cook-off temperature. As such, little or no shrapnel is produced and damage to nearby facilities or personnel is minimized.

The explosive composition of the present invention may be used in a munition, such as an IM. For instance, the explosive composition may be used in a warhead 2, as shown in FIG. 1. The warhead 2 may include the confinement or case 4 and an explosive charge 6 formed from the explosive composition of the present invention. However, it is understood that the explosive composition may also be used in additional types of munitions.

To determine the effect of the additive in a slow cook-off situation, the explosive composition of the present invention may be tested in the SBAT. SBAT is a differential thermal analysis used to determine an ignition exotherm and sensitivity to elevated temperatures of the explosive composition. The SBAT is used to predict the slow cook-off reaction temperature of a bulk explosive composition using only a small quantity of material. The SBAT heats gram quantities of the material at a rate of 24° F./hr in a near-adiabatic cell. The temperature range of the SBAT is 0° to 500° F. This test is similar to the Differential Scanning Calorimeter ("DSC") test, which is known in the art, but provides a better predictor of large-scale cook-off temperatures. In a temperature trace produced by the SBAT, it is desirable that the explosive composition exhibits two exothermic peaks or one exotherinic peak that is present at a lower temperature than an exothermic peak of the neat explosive composition.

Figure 2:
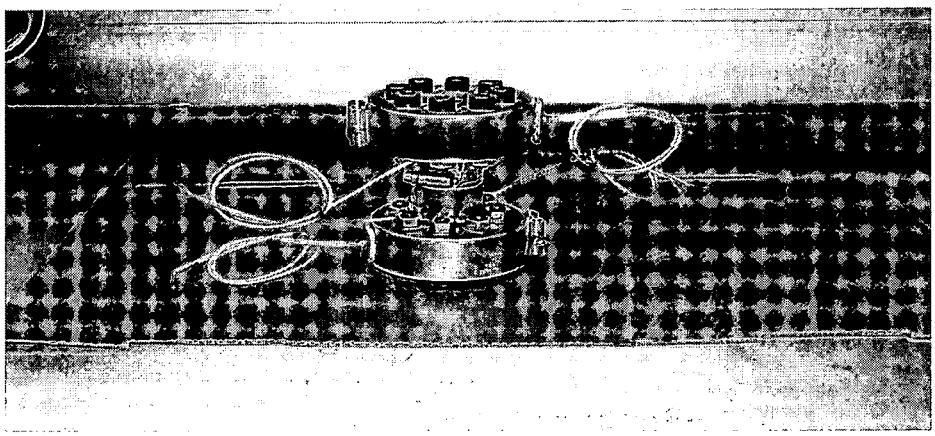
FIG. 2 illustrates the test equipment used in a Scale Thermal Explosion Experiment ("STEX") test.

The STEX test may also be used to determine the effect of the additive on the explosive composition in a slow cook-off situation. The STEX test is a cook-off test similar in size and design to the Variable Confinement Cook-off Test ("VCCT"), which is known in the art. The STEX test mimics ullage and hydrostatic burst pressure (30,000 psi) of an M107 projectile. A main body of test equipment used in the STEX test has a 1" inside diameter tube containing the explosive composition and a probe with five thermocouples running the central length of the tube. Heavy endplates formed from about a half inch of steel are bolted on either end of the tube. When assembled, the test equipment resembles a dumbbell, as shown in FIG. 2. Three thermocouples are attached to the outside of the central tube at the middle, bottom, and top. In total, eight thermocouples are used during the STEX test to monitor the temperature at different positions in the STEX test equipment. A small hole in the top plate allows a little leakage. Heating bands are placed around the center tube and around each endplate. The STEX test is programmed to rapidly ramp up to a temperature that is about 100° F. below the lowest expected reaction temperature. Then, the temperature is ramped up at 6° F. per hour until cook-off. Fragments of the confinement produced during the cook-off may be collected using a barrier surrounding the test equipment, and quantified. The reaction violence of the explosive composition may be determined by the degree of fragmentation of the test equipment. For instance, a detonation of the explosive composition may result in large deformations of the endplates and many fragments. An explosion may produce many fragments but no deformation of the endplates. Pressure release and a mild burn of the explosive composition may produce a few fragments.

While the Examples herein describe using the additive with Comp B or replacement Comp B explosive compositions, it is understood that the additive may be used in additional explosive compositions, such as explosive compositions used as propellants or gas generants.

EXAMPLES

Example 1

Comp B Explosive Compositions Including DNPH

Explosive compositions having 50%, 5%, 4%, and 3% DNPH were formulated by weighing a desired amount of the additive and the Comp B. For example, to formulate a 100 g batch of the explosive composition having 5% DNPH, 5 g of the DNPH and 95 g of Comp B were weighed. The DNPH was dried before weighing. The DNPH and the Comp B were placed in an oven-safe container and heated in an oven at 210° F. until the Comp B melted. The mixture was stirred with a spatula until the DNPH was well mixed with the Comp B. Since the DNPH is easily mixed with the Comp B, no modifications to the existing melt-pour process for Comp B are necessary. The mixture was poured into a grounded case, a mold, or onto a velostat bag, depending on the test that was to be performed. For SBAT testing, the velostat bag technique was used to produce small, irregularly shaped pieces. After the mixture was applied onto the velostat bag, the mixture was spread to its desired thickness, allowed to cool to ambient temperature, peeled off the velostat bag, and gently broken into smaller pieces. For STEX testing, the mixture was poured and cast directly into the test equipment.

Example 2

PAX-21 Explosive Compositions Including DNPH

Explosive compositions having 50%, 5%, 4%, and 3% DNPH were formulated as described in Example 1, except that PAX-21 was used as the main explosive.

Example 3

SBAT Testing of the DNPH-Containing Explosive Composition

The explosive compositions described in Examples 1 and 2 were tested by SBAT. A test sample of each of the explosive compositions was placed in a culture tube. Approximately ¾-inch of the bottom of the culture tube was filled with each explosive composition. The test samples were insulated and heated in an aluminum thermal mass. The temperature of each of the test samples was compared to the temperature of an identically insulated, nonreactive sample. When the test sample experienced an endotherm, its temperature fell behind that of the inert sample, resulting in a negative differential temperature between the test sample and the inert sample. When the test sample experienced an exotherm, its temperature rose above that of the inert sample, resulting in a positive differential temperature between the test sample and the inert sample. During testing, the temperature was ramped 24° F./hr, until a reaction occurred.

Desirable explosive compositions showed two exothermic peaks or one exothermic peak at a lower temperature than the exothermic peak of the neat explosive composition. Table 1 provides a summary of the exotherrhic peak temperatures of the explosive compositions including DNPH. The upper number in each of the cells in Table 1 is the exothermic peak temperature of the DNPH and the lower number is the exothermic peak temperature of the Comp B or PAX-21, depending on which main explosive was tested.

TABLE 1

Exothermic Peak Temperatures of the Explosive Compositions Including DNPH

| | 50% with Comp B | 50% with PAX-21 | 5% with Comp B | 5% with PAX-21 | 4% with Comp B | 4% with PAX-21 | 3% with Comp B | 3% with PAX-21 |
|---|---|---|---|---|---|---|---|---|
| Dinitrophenyl-hydrazine | 300° F. | 320° F. | 290° F.<br>345° F. | 320° F.<br>350° F. | 300° F.<br>345° F. | 320° F.<br>350° F. | 290° F.<br>340° F. | 345° F. |

Figure 3:
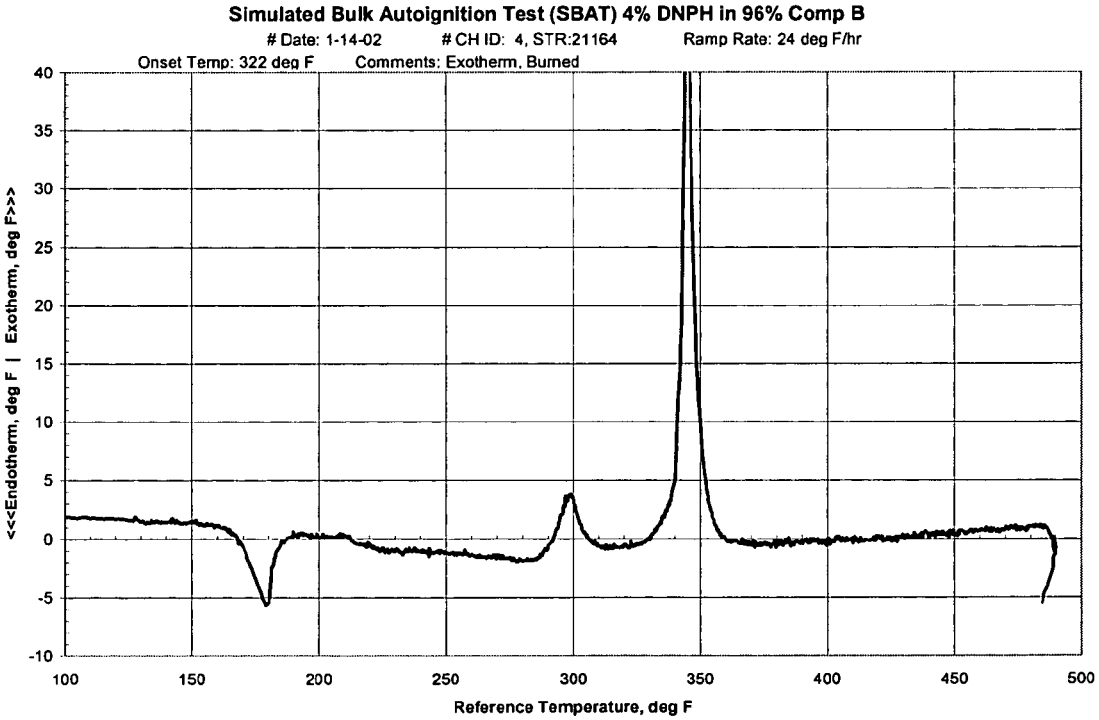
FIG. 3 shows a Simulated Bulk Autoignition Test ("SBAT") temperature trace of an explosive composition including 4% dinitrophenylhydrazine in 96% Comp B.

The explosive compositions including 50% DNPH showed one exothermic peak at a lower temperature than the exothermic peak of the neat Comp B or PAX-21. Therefore, lower amounts of DNPH were tested to determine whether the resulting explosive compositions showed two exothermic peaks. The explosive compositions having 4% DNPH or 5% DNPH showed double peaks when either the Comp B or the PAX-21 was used as the main explosive. The SBAT temperature trace for the 4% DNPH in Comp B explosive composition is shown in FIG. 3. The dip in the trace is an endothermic peak that indicates melting of the Comp B. The first exothermic peak (at approximately 299° F.) is the exothermic decomposition of the DNPH and the second exothermic peak (at approximately 345° F.) is the ignition of Comp B. SBAT temperature traces for the explosive compositions having 3% DNPH in Comp B, 5% DNPH in Comp B, 4% DNPH in PAX-21, and 5% DNPH in PAX-21 were similar to that shown in FIG. 3. However, the explosive composition having 3% DNPH in PAX-21 did not show double peaks.

Example 4

STEX Testing of the DNPH-Containing Explosive Composition

Explosive compositions having 3% and 4% DNPH in Comp B and 3% and 5% DNPH in PAX-21 were tested by STEX testing. Each of the explosive compositions was poured into the central tube, around the probe, and allowed to solidify. To prevent cracks due to cooling shrinkage, a small amount of the mixture is first poured into the test equipment and allowed to cool. Then, additional material is poured and allowed to cool, which is repeated until the test equipment is completely full. The STEX test is programmed to rapidly reach 100° F. below the expected lowest reaction temperature and then soak for two hours. The temperature is then increased at 6° F. per hour until cook-off. The eight thermocouples monitored the temperature at different positions in the STEX test equipment until cook-off. Fragments of the confinement produced in the explosion were caught by the barrier surrounding the test equipment. The reaction violence was determined by the degree of fragmentation of the test equipment.

For comparison, a controlled burn/overpressure test was conducted using 15 g of JA-2 gun propellant. JA-2 was chosen as a control because it is know to burn uniformly at pressures greater than 90,000 psi and because the propellant grains were fairly large and had a relatively small surface area. The JA-2 grain is about 0.6 in. long and ⅜ in. in diameter with seven perforations. Approximately ten grains are used to supply the 15 g of gun propellant, with each grain having an initial surface area of about 1.34 $in^2$. The JA-2 should produce a pressure of approximately 60,000 psi in the STEX test. The JA-2 gun propellant was ignited in the STEX test equipment at ambient conditions. None of the bolts were torn apart but the cylinder was torn away from the endplates into two mangled pieces. The explosive composition of the present invention showed comparable or improved results compared to this controlled burn.

Figure 4:
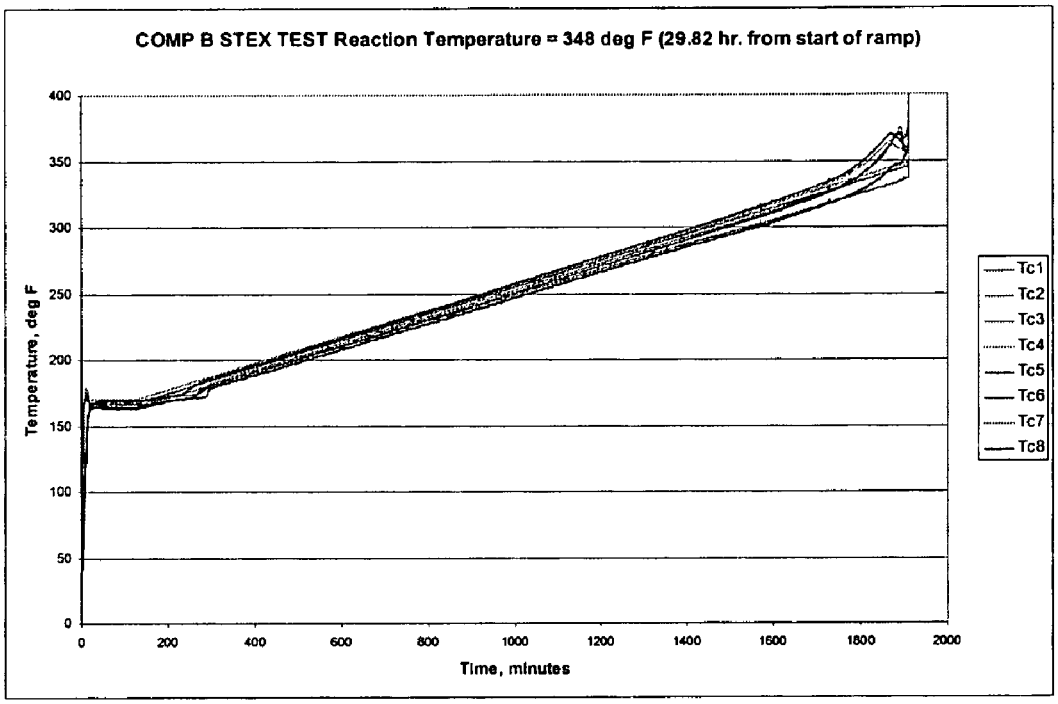
FIG. 4 shows an STEX temperature trace of neat Comp B.
Figure 5:
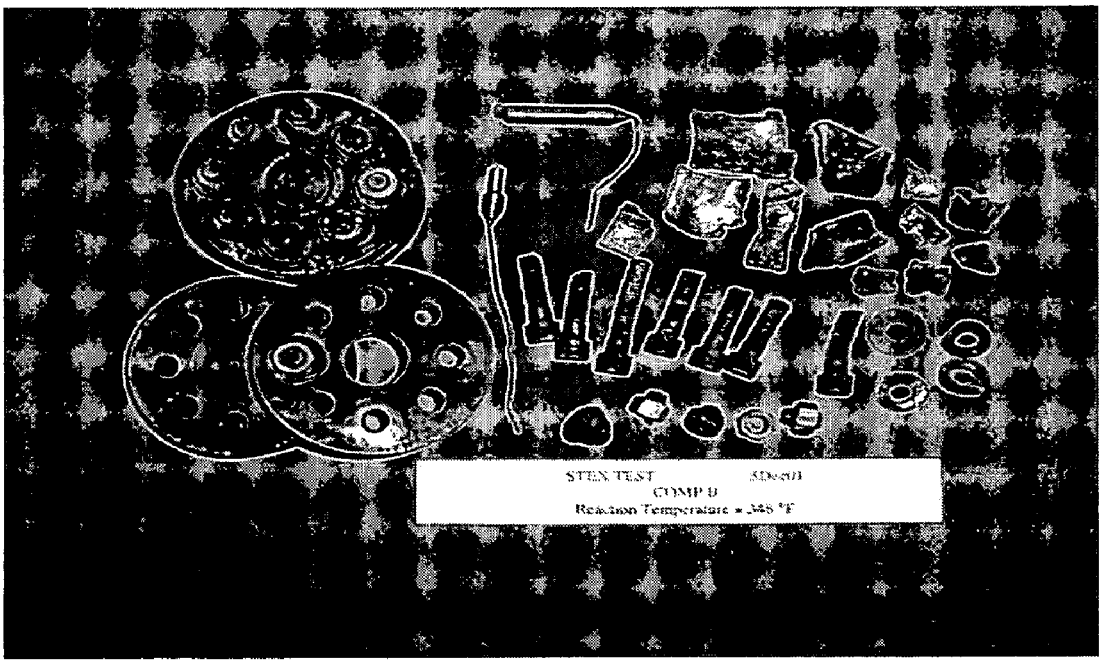
FIG. 5 shows remains of the STEX test equipment after cook-off of neat Comp B.

STEX testing was also performed on neat Comp B and neat PAX-21 as control samples. While both of the neat explosive compositions exploded, neither of the neat explosive compositions detonated. Detonation occurs at a speed faster than the speed of sound while an explosion occurs at a speed slower than the speed of sound. Each of the eight thermocouples monitored the temperature at different positions in the STEX test equipment, as indicated by TC1-TC8 in the STEX temperature traces. Neat Comp B melted at a temperature of about 175° F., as evidenced in FIG. 4 by the short period of pressure/time stability at that temperature. The temperature of the neat Comp B then steadily increased until the explosive composition reacted at a temperature of 348° F. At this temperature, where Comp B cooked off, the test equipment was blown into many fragments. The remains of the test equipment using neat Comp B produced twelve small shrapnel pieces, as shown in FIG. 5.

Figure 6:
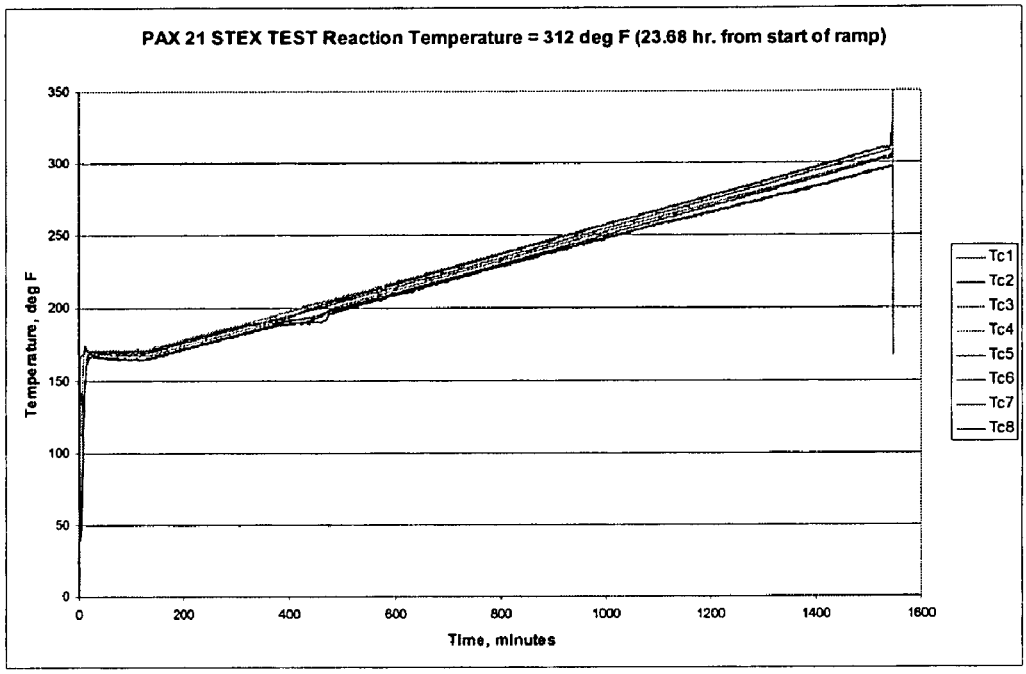
FIG. 6 shows an STEX temperature trace of neat PAX-21.
Figure 7:
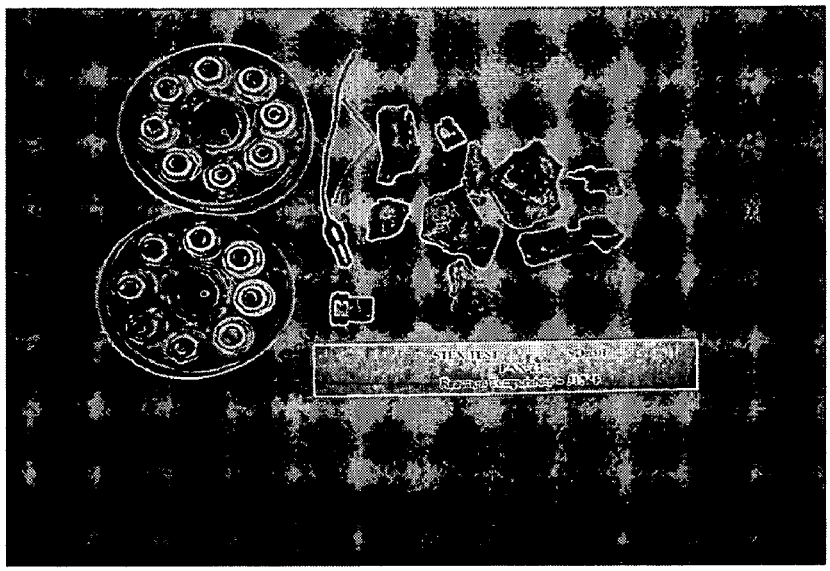
FIG. 7 shows remains of the STEX test equipment after cook-off of neat PAX-21.

STEX testing was also performed on neat PAX-21. Neat PAX-21 melted at a temperature of about 190° F., as indicated in FIG. 6. The temperature then steadily increased until the PAX-21 cooked off at approximately 312° F. As shown in FIG. 7, nine pieces of shrapnel were recovered: three small pieces of the central part of the test equipment, six mangled heating bands, and the end pieces. The three recovered pieces of the test equipment did not account for all the material used in the test equipment and, therefore, much of the test equipment was not recovered.

Figure 8:
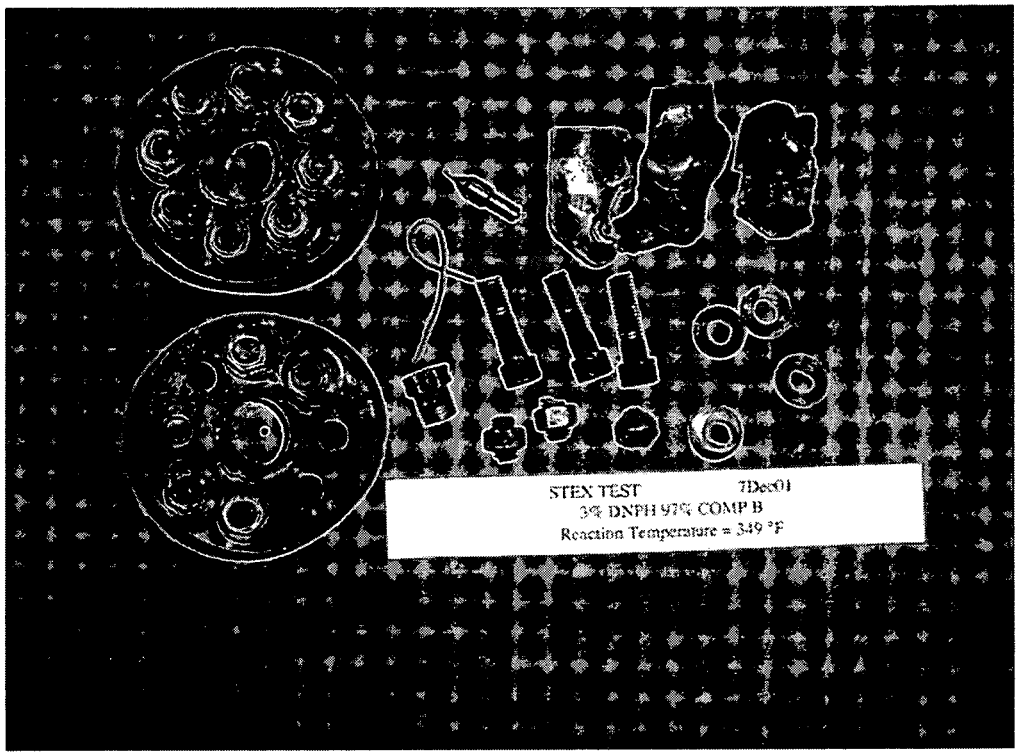
FIG. 8 shows remains of the STEX test equipment after cook-off of an explosive composition having 3% DNPH in Comp B.
Figure 9:
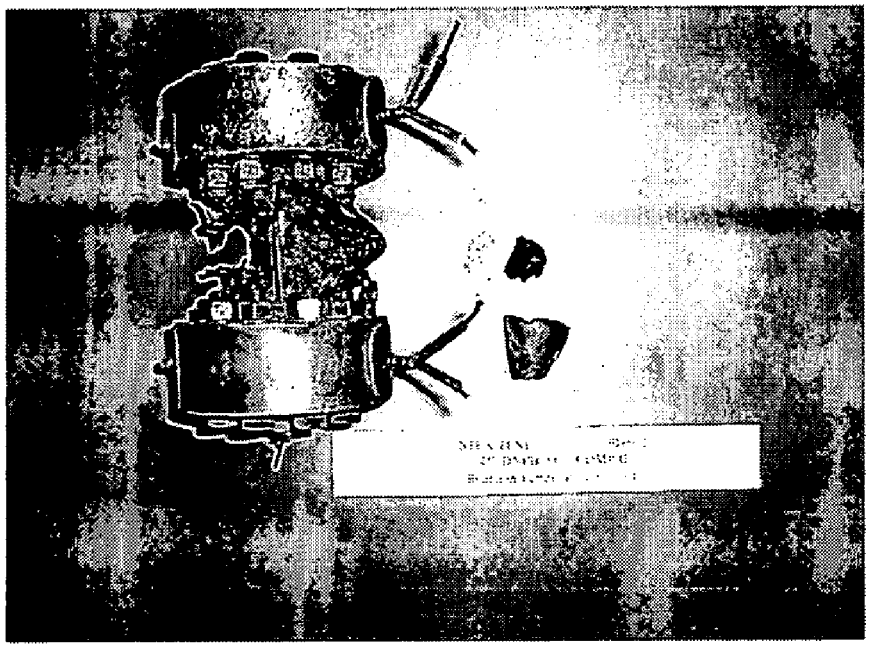
FIG. 9 shows remains of the STEX test equipment after cook-off of an explosive composition having 4% DNPH in Comp B.
Figure 10:
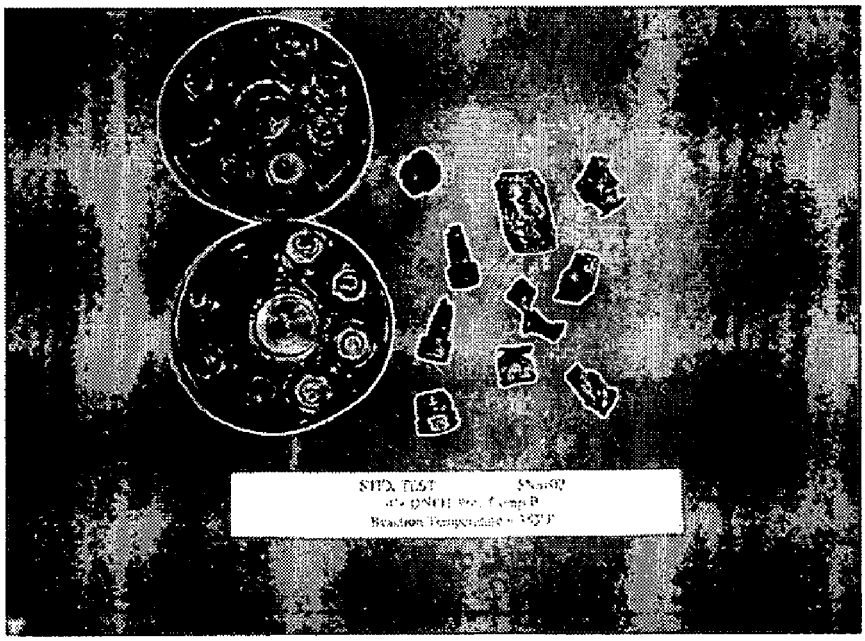
FIG. 10 shows remains of the STEX test equipment after cook-off of an explosive composition having 4% DNPH in Comp B using a different batch of DNPH.

In contrast, the explosive composition including 3% DNPH in Comp B showed an exothermic peak at 340° F., followed by the main explosion at 349° F. As shown in FIG. 8, the central part of the test equipment was split into two mangled pieces, similar to the results seen in the overpressure test with the JA-2 gun propellant. When the DNPH was increased to 4%, over half of the central part of the test equipment remained intact, albeit distorted, and only two other pieces of shrapnel were recovered, as shown in FIG. 9. The pressure trace for the explosive composition having 4% DNPH was similar to that of the explosive composition including 3% DNPH. However, when the 4% DNPH explosive composition was repeated using a different batch of DNPH, the end pieces of the test equipment were bowed, which is an indication of detonation, as shown in FIG. 10. However, the pressure trace of this explosive composition was consistent with that of the previous tests.

The only difference between the two tests of the 4% DNPH explosive composition was that a new batch of DNPH was used in the second test. It is believed that the old batch had partially decomposed and that either one of the decomposition products was responsible for the overpressure event or less DNPH is required to obtain the desired reaction. The most common decomposition products are 2,4-dinitrophenol, 2,4-dinitroaniline, and 1,3-dinitrobenzene. The two batches of DNPH were indistinguishable by infrared ("IR") and high pressure liquid chromatography ("HPLC"), which showed the presence of dinitrobenzene and 1-chloro-2,4-dinitroenzene. However, differences between the two batches were found by gas chromatography/mass spectroscopy ("GC/MS"). The old batch had 1.551% dinitrobenzene and 2.954% 1-chloro-2,4-dinitrobenzene and the new batch had 2.109% dinitrobenzene and 3.031% 1-chloro-2,4-dinitrobenzene. It is not certain whether these chemical differences between the old and new batches of DNPH explain the different results in the STEX tests.

Figure 11:
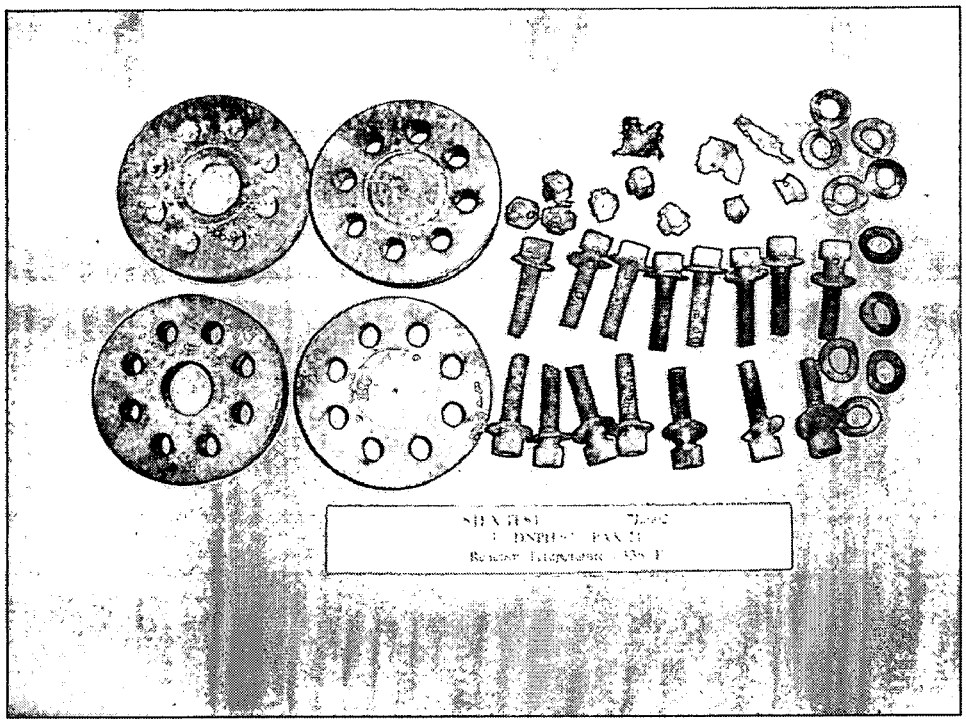
FIG. 11 shows remains of the STEX test equipment after cook-off of an explosive composition having 3% DNPH in PAX-21.
Figure 12:
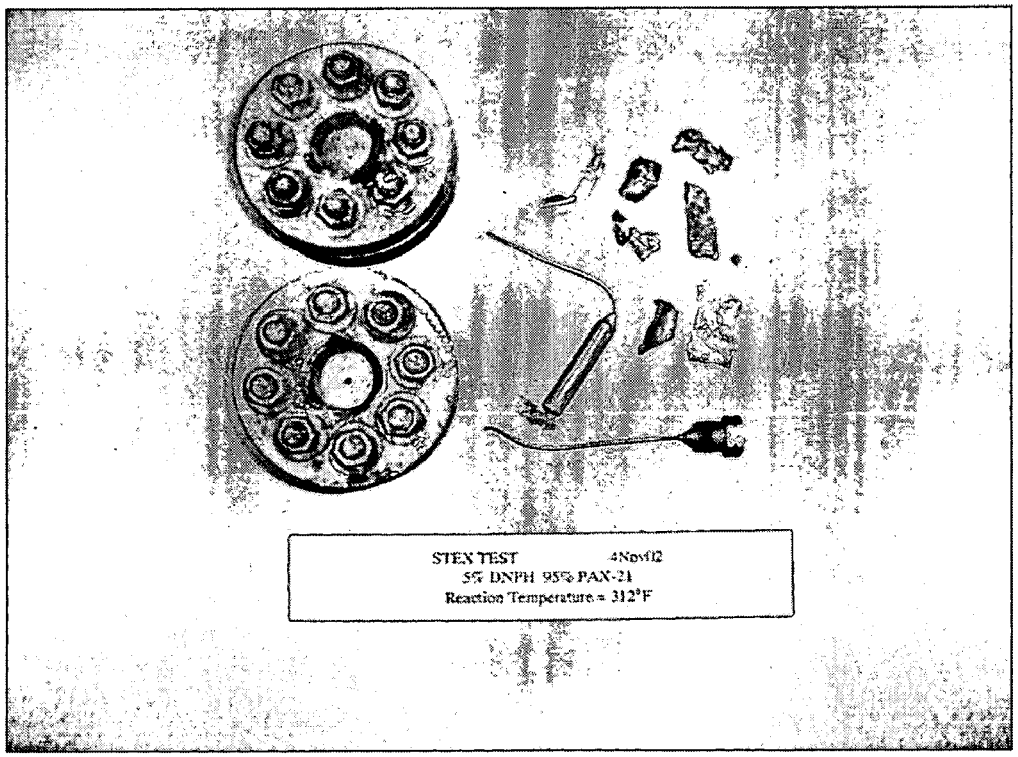
FIG. 12 shows remains of the STEX test equipment after cook-off of an explosive composition having 5% DNPH in PAX-21.

With the explosive composition including 3% DNPH in PAX-21, only four small pieces of shrapnel were recovered, as shown in FIG. 11. The remainder of the material making up the test equipment was not recovered. With the explosive composition having 5% DNPH in PAX-21, six pieces of shrapnel were recovered, as shown in FIG. 12.

A summary of the reaction temperatures and a description of the remains of the test equipment for each of the formulations are provided in Table 2.

TABLE 2

Summary of STEX Results for the DNPH-Containing Explosive Compositions.

| Explosive Composition | Reaction Temp. (° F.) | Time (hr) | Description of Test Equipment Remains |
|---|---|---|---|
| Neat Comp B | 348 | 29.82 | 12 pieces shrapnel |
| 3% DNPH in 97% Comp B | 349 | 29.8 | 2 large shrapnel pieces |
| 4% DNPH in 96% Comp B | 353 | 30.72 | 2 large shrapnel pieces, most of test equipment intact |
| 4% DNPH in 96% Comp B | 353 | 28.98 | 6 pieces shrapnel, end pieces bowed out-possible detonation |
| Neat PAX-21 | 312 | 23.68 | 9 pieces shrapnel |
| 3% DNPH in PAX-21 | 336 | 27.67 | 4 small pieces found, rest is missing |
| 5% DNPH in PAX-21 | 312 | 25.35 | 6 pieces shrapnel |

Example 5

Safety Data for DNPH-Containing Explosive Compositions

Explosive compositions having 4% DNPH in Comp B and 3% DNPH in PAX-21 were also tested for safety considerations. Conventional safety properties, such as ABL friction, ABL impact, TC electrostatic discharge, VTS average gas evolution, SBAT Onset temperature, and TC impact testing, were determined for these explosive compositions. The safety properties were used to determine whether the explosive compositions had a low level of sensitivity (green line ("GL")), an intermediate level of sensitivity (yellow line ("YL")), or a high level of sensitivity (red line ("RL")). The overall rating assigned to each of the explosive compositions is the lowest (most conservative) rating received from the basic safety tests.

The explosive compositions having 4% DNPH in Comp B and 3% DNPH in PAX-21 were ground to a fine powder. A fine powder is typically the most sensitive form of the explosive composition compared to chunks and castings, which are less sensitive especially to electrostatic discharge. The safety data for these explosive compositions was determined by conventional techniques and is shown in Table 3, along with safety data for the neat explosive compositions. The properties reported for the neat Comp B and neat PAX-21 were obtained from archives and were not necessarily obtained by testing materials that were ground to a fine powder.

The addition of the DNPH did not affect the classification of the explosive compositions. Neat Comp B had a high sensitivity, as did the explosive composition having 4% DNPH in Comp B, while neat PAX-21 and the explosive composition having 3% DNPH in PAX-21 had an intermediate sensitivity.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An explosive composition having a slow cook-off, comprising:

a main explosive comprising cyclo-1,3,5-trimethylene-2,4,6-trinitramine and trinitrotoluene or cyclo-1,3,5-trimethylene-2,4,6-trinitramine, dinitroanisole, ammonium perchlorate, and n-methyl-4-nitroaniline; and 2,4-dinitrophenylhydrazine.

2. The explosive composition of claim 1, wherein the 2,4-dinitrophenylhydrazine is present in an explosive composition at less than or equal to approximately 5% by weight.

TABLE 3

Safety Data for Explosive Compositions including DNPH

| Explosive Composition | ABL Impact (cm) | ABL Friction (lbs) | TC ESD unconfined (J) | VTS average gas evolution (mL/g) | SBAT Onset Temp. (° F.) | TC Impact (in) | Overall Class |
|---|---|---|---|---|---|---|---|
| Neat Comp B | 21 | 800 | 0.68 | | 325 | >46 | RL |
| 4% DNPH in Comp B | 13 | 800 | 0.5 | 2.221 | 322 | 45 | RL |
| Neat PAX-21 | 6.9 | 800 | | | 334 | 30.64 | YL |
| 3% DNPH in PAX-21 | | 50 | 1.0 | | 329 | 19.67 | YL |

3. The explosive composition of claim 1, wherein the 2,4-dinitrophenylhydrazine is present in an explosive composition at less than or equal to approximately 4% by weight.

4. An insensitive munition resistant to slow cook-off, comprising:

an explosive composition comprising a main explosive and 2,4-dinitrophenylhydrazine, the main explosive comprising cyclo-1,3,5-trimethylene-2,4,6-trinitramine and trinitrotoluene or cyclo-1,3,5-trimethylene-2,4,6-trinitramine, dinitroanisole, ammonium perchlorate, and n-methyl-4-nitroaniline; and a confinement comprising the explosive composition.

5. The insensitive munition of claim 4, wherein the 2,4-dinitrophenylhydrazine is present in the explosive composition at less than or equal to approximately 5% by weight.

6. The insensitive munition of claim 4, wherein the 2,4-dinitrophenylhydrazine is present in the explosive composition at less than or equal to approximately 4% by weight.

7. A method of forming an explosive composition resistant to slow cook-off, comprising:

providing a main explosive comprising cyclo-1,3,5-trimethylene-2,4,6-trinitramine;

melting the main explosive; and adding 2,4-dinitrophenylhydrazine to the melted main explosive to form an explosive composition.

8. The method of claim 7, wherein providing a main explosive comprising cyclo-1,3,5-trimethylene-2,4,6-trinitramine comprises providing trinitrotoluene and cyclo-1,3,5-trimethylene-2,4,6-trinitramine.

9. The method of claim 7, wherein providing a main explosive comprising cyclo-1,3,5-trimethylene-2,4,6-trinitramine comprises providing dinitroanisole, ammonium perchlorate, n-methyl-4-nitroaniline, and cyclo-1,3,5-trimethylene-2,4,6-trinitramine.

10. The method of claim 7, wherein adding 2,4-dinitrophenylhydrazine to the melted main explosive comprises adding less than or equal to approximately 5% by weight of the 2,4-dinitrophenylhydrazine to the melted main explosive.

11. The method of claim 7, wherein adding 2,4-dinitrophenylhydrazine to the melted main explosive comprises adding less than or equal to approximately 4% by weight of the 2,4-dinitrophenylhydrazine to the melted main explosive.

12. The method of claim 7, further comprising casting the explosive composition.

13. A method of mitigating slow cook-off violence, comprising:

providing an explosive composition comprising a main explosive and 2,4-dinitrophenylhydrazine, the main explosive comprising cyclo-1,3,5-trimethylene-2,4,6-trinitramine and trinitrotoluene or cyclo-1,3,5-trimethylene-2,4,6-trinitramine, dinitroanisole, ammonium perchlorate, and n-methyl-4-nitroaniline, wherein the explosive composition is encased in a confinement;

decomposing the 2,4-dinitrophenylhydrazine to generate a gas; and generating a sufficient gas pressure to breach the confinement without producing shrapnel.

14. The method of claim 13, wherein providing an explosive composition comprising a main explosive and -2,4-dinitrophenyl-hydrazine comprises providing the explosive composition comprising less than or equal to approximately 5% by weight of the 2,4-dinitrophenylhydrazine.

15. The method of claim 13, wherein providing an explosive composition comprising a main explosive and 2,4-dinitrophenyl-hydrazine comprises providing the explosive composition comprising less than or equal to approximately 4% by weight of the 2,4-dinitrophenylhydrazine.

16. The method of claim 13, wherein decomposing the 2,4-dinitrophenylhydrazine to generate a gas comprises exposing the confinement to a temperature sufficient to decompose the 2,4-dinitrophenylhydrazine.

17. The method of claim 13, wherein decomposing the 2,4-dinitrophenylhydrazine to generate a gas comprises exposing the confinement to a temperature above a melting point of the main explosive and below a reaction temperature of the main explosive.

18. The method of claim 13, wherein generating a sufficient gas pressure to breach the confinement without producing shrapnel comprises generating the sufficient gas pressure in a short amount of time.

19. The method of claim 13, further comprising burning the main explosive.

* * * * *

UNITED STATES PATENT AND TRADEMARK OFFICE

CERTIFICATE OF CORRECTION

PATENT NO. : 7,033,449 B2
APPLICATION NO. : 10/385379
DATED : April 25, 2006
INVENTOR(S) : Ruth A. Shaefer, Robert L. Hatch and Daniel W. Doll It is certified that error appears in the above-identified patent and that said Letters Patent is hereby corrected as shown below:

| | | | |
|---|---|---|---|
| | COLUMN 8, | LINE 51, | change "exotherrhic peak" to --exothermic peak-- |
| CLAIM 14, | COLUMN 14, | LINE 19, | change "-2,4-" to -- 2,4- -- |

Signed and Sealed this

Twelfth Day of December, 2006

JON W. DUDAS
*Director of the United States Patent and Trademark Office*